United States Patent [19]

Lusk

[11] 4,395,935

[45] Aug. 2, 1983

[54] WEAR PLATE FOR TRUNNION BLOCKS

[75] Inventor: Norman E. Lusk, Kitchener, Canada

[73] Assignee: Her Majesty the Queen in right of Canada, as represented by the Minister of National Defence, Ottawa, Canada

[21] Appl. No.: 283,139

[22] Filed: Jul. 14, 1981

[30] Foreign Application Priority Data

Jul. 24, 1980 [CA] Canada ..... 358799

[51] Int. Cl.[3] ..... F41F 23/00

[52] U.S. Cl. ..... 89/37 E

[58] Field of Search ..... 89/37 R, 37 B, 37 E, 89/41 T

[56] References Cited

U.S. PATENT DOCUMENTS

| | | | |
|---|---|---|---|
| 555,346 | 2/1896 | Stuckstede | 89/37 E |
| 814,859 | 3/1906 | Meigs et al. | 89/37 E |
| 3,854,377 | 12/1974 | Schiele | 89/37 E |
| 4,325,284 | 4/1982 | Grünewald et al. | 89/37 E |

*Primary Examiner*—Stephen C. Bentley

*Assistant Examiner*—Maureen T. Ryan

*Attorney, Agent, or Firm*—Larson & Taylor

[57] ABSTRACT

An improved receiver assembly adapted for use in a weapon that fires cartridges fed into the same from an ammunition belt having metal links. The assembly includes a trunnion block having a surface and two oppositely disposed sides. The surface is delimited on two opposed sides thereof by retaining means formed along said edges of the trunnion block. A wear plate is adapted to removably overlie the surface, and absorbs contact from the metal links. The wear plate is planar, being made of hardened spring metal, preferably steel, type AISI C 1045, hardened to $R_c$48-52. Two opposed edges of the wear plate have fastening means, preferably in the form of C-shaped flanges. These resiliently grip the retaining means to coact therewith in securing the wear plate to the trunnion block. A manually manipulatable tongue is formed on one of the flanges of the wear plate to facilitate placement and removal of the same. The retaining means on the trunnion block are flanges defined by one side of a channel, cut either in the block itself, or on a plate secured to the sides thereof.

10 Claims, 3 Drawing Figures

WEAR PLATE FOR TRUNNION BLOCKS

This invention relates to improvements in trunnion blocks. More particularly, the invention relates to an improved receiver assembly adapted for use in a weapon that fires cartridges fed into the same from a cartridge belt, in which assembly a novel trunnion block and wear plate combination are provided.

In the weapons and armaments field there are many instances where a cartridge or ammunition belt is used to feed cartridges to the weapon. Such a belt normally includes hardened steel links. Whether the steel links of an ammunition belt are hardened or not, drawing the same across the top face or surface of a trunnion block in the receiver assembly of the weapon creates wear. Often, scoring or gouging of that surface also occurs. In time it clearly becomes necessary either to repair or replace the trunnion block. Such damage and wear have to date simply been considered as "normal gun wear". A trunnion block as envisaged herein, is an integral part of the receiver assembly. Moreover, depth of wear exceeding 0.015 inches will necessitate replacement of the trunnion block. Trunnion blocks are often difficult to obtain, as will be recognized by person knowledgeable in this art.

Notwithstanding that, there is at present no known method or technique of salvaging receivers with trunnion blocks worn beyond the permissible limit noted above. It is, therefore, an object of this invention to provide an improved receiver assembly design which overcomes certain deficiencies of the prior art. The present invention is relatively simple structurally, and reliable.

Accordingly, there is provided by one embodiment of this invention an improved receiver assembly adapted for use in a weapon that fires cartridges fed into the same from an ammunition belt having metal links, the improvement comprising: a trunnion block having a surface, and two oppositely disposed edges, the surface being delimited on two opposed sides by retaining means provided along the edges of the trunnion block; and a wear plate of hardened spring metal adapted to overlie the surface of the trunnion block, the wear plate having two opposed edges with fastening means thereon, the fastening means being configured to coact with the retaining means to releasably secure the wear plate to the trunnion block.

In a more preferred form of the invention, the trunnion block is itself configured along the oppositely disposed edges to provide slot means spaced from the plane of the surface, so as to form the retaining means as a flange that extends coterminously of the oppositely disposed edges.

As another embodiment of this invention, plate means are provided, secured to opposed sides of the trunnion block so that an edge of each plate means forms one of the oppositely disposed edges, the plate means being formed with a channel therein adjacent the previously mentioned edge thereof, such channel forming on one side thereof flange means which coact to form the retaining means which hold the wear plate in place.

These and other features and advantages of this invention will become apparent from the detailed description below. That description is to be read in conjunction with the accompanying drawings, in which.

Figure 1:
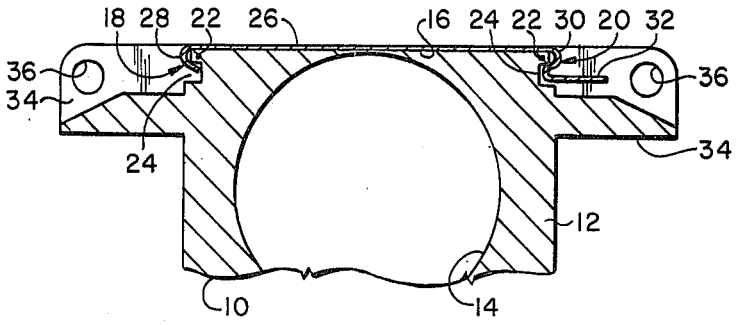
FIG. 1 is an elevation view taken in lateral cross-section to illustrate a receiver assembly embodying one form of this invention.

Turning now to FIG. 1, there is shown a lateral cross-sectional view of a receiver assembly 10. The assembly 10 is conventional in its basic configuration, being adapted to be mounted in a weapon such as a machine gun, in a manner well known in this art. Thus, the receiver assembly 10 includes a trunnion block 12 having a central bore 14 extending longitudinally of the weapon, not shown. A wear surface 16 is formed by an upper side of the trunnion block 12, and is delimited by two opposed sides 18, 20. Associated with each of the sides 18, 20 are side flanges 22 and slots or channels 24. The outwardly facing corner of each flange 22 is slightly bevelled. The flanges 22 define one side of the slots 24, and together can be considered to constitute retaining means for a wear plate 26.

This wear plate 26 is secured to trunnion block 12 to overlie the surface 16. The wear plate 26 is substantially planar, and made of a hardened metal, preferably spring steel, type AISI C 1045 hardened to $R_c$48–52. As seen from the drawing, FIG. 1, wear plate 26 also has two opposed edges 28, 30. These edges 28, 30 are configured to coact with flanges 22 and slots 24 to enable the wear plate 26 to be removably retained in place. The edges 28, 30, in this instance are formed as C-shaped flanges. One of these flanges, numbered 30, in the drawing (FIG. 1) includes a tongue section 32 extending from the flange. Tongue section 32 is manually manipulatable to facilitate rapid and easy placement onto and removal of the wear plate 26 from surface 16. It is noted that wear plate 26 is capable of being positioned or mounted on wear surface 16 from either side of the receiver assembly 10.

Figure 2:
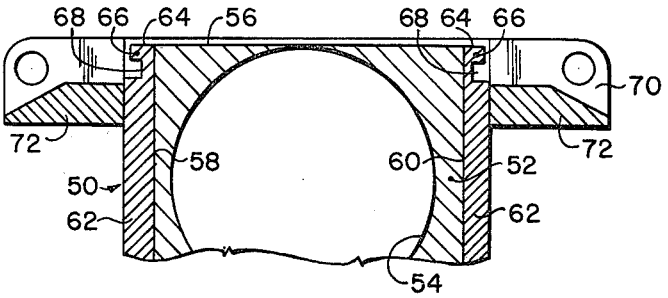
FIG. 2 is also an elevation view taken in lateral cross-section to show a receiver assembly embodying another form of this invention.
Figure 3:
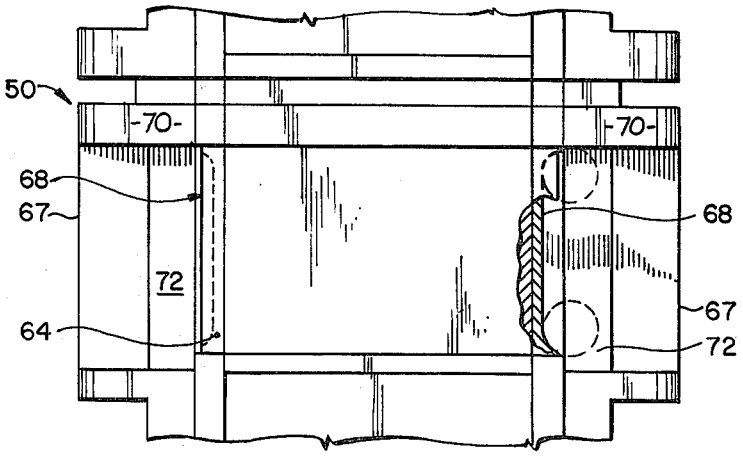
FIG. 3 is a plan view of the apparatus of FIG. 2.

In another embodiment of the invention, FIG. 2 shows a receiver assembly 50. As before, the receiver assembly 50 includes a trunnion block 52 having a central bore 54. The trunnion block 52 has a wear surface 56, delimited at two opposed edges thereof by sides 58, 60 of the block. Rivetted to each of the sides 58, 60 is a side plate 62 having an edge 64 positioned substantially coplanar with wear surface 56. Formed into plates 62 adjacent these edges 64 are a combination flange 66 and slot 68 coacting to form retaining means for a wear plate (not shown). This wear plate is removably secured to trunnion block 52, in the same manner as wear plate 26 of FIG. 1, and is of the same shape, material, etc. As best seen from FIG. 3, the trunnion block 52 includes brackets 67 with both vertical and horizontal segments 70, 72. These directional orientations are with respect to receiver assembly 50 mounted in a weapon ready for use.

As previously noted, it is essential to prevent wear of the surface 56 or 16 (FIGS. 2 and 1, respectively) from exceeding a predetermined maxiumum amount. To compensate for this wear, applicant envisages, according to this invention, machining of those surfaces 56 or 16, as required, followed by the placement thereon of the hardened spring metal wear plate 26. The "retaining means" for the particular variations of the invention illustrated herein are a flange and slot combination, adapted to coact with the turned over edges or flanges on the wear plate itself. Other variations will become evident to persons skilled in this art.

It is intended, therefore, to encompass all such arrangements as would be evident to such persons and which fall within the scope of the claims below.

I claim:

1. In a receiver assembly adapted for use in a weapon that fires cartridges fed into the same from an ammunition belt having metal links, the improvement comprising;

a trunnion block having a surface, and two oppositely disposed edges, said surface being delimited on two opposed sides by retaining means provided along said edges of the trunnion block; and a wear plate of hardened spring metal adapted to overlie said surface of the trunnion block, the wear plate having two opposed edges with fastening means thereon, said fastening means comprising springy flanges configured to coact with said retaining means to releasably secure the wear plate to said trunnion block.

2. The invention defined in claim 1, wherein the wear plate includes a manually manipulatable tongue secured to one of said opposed edges, thereby to enable the wear plate to be snapped into, and out of, place on the trunnion block.

3. The invention defined in claim 2, wherein said fastening means and tongue on one of said opposed edges are integrally joined, being generally of a S-shape.

4. The invention defined in claim 1, 2 or 3, wherein the trunnion block is itself configured along said oppositely disposed edges to provide slot means spaced from the plane of said surface, so as to form said retaining means as a flange that extends coterminously of said oppositely disposed edges.

5. The invention defined in claim 1, 2 or 3, wherein plate means are provided, secured to opposed sides of the trunnion block so that an edge of each plate means forms one of said oppositely disposed edges, the plate means being formed with a channel therein adjacent the previously mentioned edge thereof, such channel forming on one side thereof flange means which coact to form said retaining means which hold the wear plate in place.

6. The invention defined in claim 1, 2 or 3, wherein said wear plate is of steel, type AISI C 1045, and hardened to $R_c$ 48–52.

7. The invention defined in claim 1, 2 or 3, wherein said wear plate has a centrally disposed longitudinal axis extending transversely of the same, said wear plate having mirror image symmetry about said axis.

8. An improved receiver assembly adapted for use in a weapon that fires cartridges fed into the same from an ammunition belt having metal links, comprising;

a trunnion block having a surface delimited on two opposed sides thereof by flange means formed on two corresponding sides of the trunnion block; and a wear plate of hardened spring steel adapted to overlie the surface on said trunnion block, said wear plate having a planar portion with two long sides and two short sides, the short sides being formed with depending fastening means, said fastening means comprising springy flanges coacting with said flange means of said trunnion block to releasably secure the wear plate to said trunnion block and withstand contact by said metal links.

9. The invention defined in claim 8, wherein said springy flanges comprise C-shaped flanges which snap into engagement with said flange means on the trunnion block.

10. The invention defined in claim 8 or 9, wherein said springy flanges comprise C-shaped flanges, and one of said flanges includes a tongue manipulatable by hand to enable said wear plate to be snapped into, or out of position on the trunnion block.

* * * * *